US005143513A

United States Patent [19]

Ellingson et al.

[11] Patent Number: 5,143,513

[45] Date of Patent: Sep. 1, 1992

[54] DISHWASHER PUMP

[75] Inventors: David I. Ellingson, Newton; Herbert E. Scott, Kellogg; James E. Sparks, Newton, all of Iowa

[73] Assignee: Maytag Corporation, Newton, Iowa

[21] Appl. No.: 612,800

[22] Filed: Nov. 14, 1990

[51] Int. Cl.[5] ..... F01D 5/12

[52] U.S. Cl. ..... 415/119; 415/144; 415/152.2; 415/153.1; 416/181; 416/182; 416/223 B; 416/231 R; 134/176; 134/179

[58] Field of Search ..... 415/52.1, 119, 121.2, 415/144, 152.1, 152.2, 153.1; 416/93, 223 A, 223 B, 231 R, 179, 182, 185, 181; 134/115 G, 176, 179, 195

[56] References Cited

U.S. PATENT DOCUMENTS

| | | | |
|---|---|---|---|
| 1,524,320 | 1/1925 | Sparks | 415/52.1 |
| 2,400,434 | 5/1946 | Nelson . | |
| 3,294,102 | 12/1966 | Ruspino et al. . | |
| 3,324,796 | 6/1967 | LaFlame . | |
| 3,353,553 | 11/1967 | Lind et al. . | |
| 3,648,931 | 3/1972 | Jacobs | 134/179 |
| 4,350,306 | 9/1982 | Dingler et al. | 134/115 G |
| 4,355,954 | 10/1982 | Wilson . | |
| 4,448,359 | 5/1984 | Meyers | 134/115 G |
| 4,753,570 | 6/1988 | Jarvis . | |
| 4,795,102 | 1/1989 | Jordan et al. | 134/115 G |
| 4,964,783 | 10/1990 | Haverkamp . | |

FOREIGN PATENT DOCUMENTS

| | | | |
|---|---|---|---|
| 750326 | 8/1933 | France . | |
| 1101771 | 10/1955 | France . | |
| 2386705 | 12/1978 | France | 415/144 |
| 0109799 | 8/1980 | Japan | 415/119 |

*Primary Examiner*—Edward K. Look
*Assistant Examiner*—Christopher M. Verdier
*Attorney, Agent, or Firm*—Richard L. Ward; Allan P. Orsund

[57] ABSTRACT

The present invention is directed to a two chamber dishwasher pump wherein the pumping noise associated with recirculation is substantially lowered by reducing the intake area to the recirculation impeller thereby interrupting air pockets formed in the fluid while recirculating. In addition the noise associated with fluid drainage is minimized by an aperture between the drain chamber inlet and the drain outlet which allows fluid to flow from the inlet to the outlet thereby interrupting air pockets in the drain line which create the noise. In addition, fluid flows through the aperture in an opposite direction to that described above in order to relieve excessive pressure in the drain line during recirculation.

3 Claims, 2 Drawing Sheets

DISHWASHER PUMP

BACKGROUND OF THE INVENTION

1. Field of the Invention

This invention relates to a dishwasher pump and more particularly to a dishwasher pump that reduces pump noise associated with the recirculation cycle and pump noise and sink/disposer splashing associated with the drain cycle.

2. Description of the Prior Art

It is common in some dishwasher pumps to include two pumping chambers with two impellers connected to a common shaft. In the recirculating mode, the impellers are both rotated in one direction thereby recirculating the washing fluid within the washing chamber. In the drain mode, both impellers are rotated in the opposite sense.

During recirculation, noise is often created in the recirculating pump by air pockets contained in the fluid striking the pump's impeller. In addition, the drain pump, although it does not operate efficiently, still attempts to pump fluid out of the appliance thereby creating a pressure head in the drain outlet.

During the drain cycle, fluid can be pumped out under great pressure causing splash at the end of the drain line. Towards the end of the drain cycle there is only a little fluid, known as a slug, left to be pumped out. The slug is pumped out into the drain outlet followed by a pocket of air. The slug travels up the drain line formed as a vertical loop alongside the dishwasher and then gravity pulls the slug back into the pump where it strikes the pump impeller thereby creating noise. This continues in a rhythmic pattern as the pump continues to propel the slug of fluid up the drain line.

There are pumps in the prior art that eliminate noise in a recirculation pump during the drain cycle and in the drain pump during the recirculation cycle. U.S. Pat. No. 3,294,102 (Ruspino et al) discloses a way of eliminating noise created in the recirculation pump during the drain cycle. The noise is created by the impeller blades of the recirculation pump which will cavitate and produce high shear forces on the water left in the recirculation pump housing causing impact on the impeller and housing. A vent is added to draw air into the impeller area of the housing of the recirculation pump thereby pushing the washing fluid away from the impeller. U.S. Pat. No. 3,353,553 (Lind et al) eliminates noise in the drain pump during recirculation by introducing air into the drain pump via an air line controlled by a valve. The air displaces any fluid that is in the drain pump during recirculation. U.S. Pat. No. 4,355,954 (Wilson) discloses a recirculation pump impeller having a modified vane structure. During the drain cycle, the fluid left in the recirculation pump mixes with air and causes a turbulent flow in the pump outlet area creating noise. The modified vane structure eliminates this noise.

None of these references eliminate noise in the recirculation pump during recirculation or noise in the drain pump during the drain cycle.

U.S. Pat. No. 3,324,796 (LaFlame) discloses a dishwasher wherein a portion of the drain pumping chamber is vented to atmosphere by vacuum breaking means. During the recirculation mode, the drain pump draws waste fluid from the looped drain into the sump. The vacuum breaking means keeps the drain outlet at atmospheric pressure during those periods thus inhibiting the drain pump from drawing fluid from the looped drain into the sump.

U.S. Pat. No. 4,753,570 (Jarvis) discloses a dishwasher pump having one impeller chamber communicating with both a conduit for delivering washing fluid and a conduit for draining the fluid. An opening between the wash conduit and the drain conduit is controlled by a diaphragm valve determining the direction of fluid flow.

The prior art does not disclose the advantages of the present invention. The present invention minimizes noise in the recirculation pump during recirculation and noise in the drain pump during drainage.

In addition, the present invention reduces the pressure in the drain line during recirculation thereby lowering the pressure head in the drain line.

Also, the present invention reduces the output pressure in the drain line during drainage thereby slowing the pump-out rate and reducing the likelihood of splash at the end of the drain line.

SUMMARY OF THE INVENTION

The present invention is directed to a dishwasher pump having a pump housing with a first and a second pumping chamber located therein. The first pumping chamber has fluid ingress and egress openings. The second pumping chamber which is axially spaced from the first pumping chamber also has fluid ingress and egress openings. A first impeller rotates in the first pumping chamber thereby moving fluid between the first pumping chamber's ingress and egress openings. A second impeller rotates in the second pumping chamber thereby moving fluid between the second pumping chamber's ingress and egress openings. A fluid feedback means is provided between the second pumping chamber and the egress opening of the second pumping chamber. Fluid can thereby flow from the egress opening to the inlet side of the second pumping chamber in order to relieve pressure downstream of the second pumping chamber. Fluid can also flow in the opposite direction from the inlet side of the second pumping chamber to the egress opening in order to lower pump noise by reducing and changing the characteristics of air pockets downstream of the second chamber.

In addition, a throttling means is associated with the intake area of the first impeller which reduces the intake area and lowers the pump noise by interrupting air pockets in the first pumping chamber prior to fluid entering the first impeller.

BRIEF DESCRIPTION OF THE DRAWINGS

Further objects and advantages of this invention will become apparent and readily appreciated from the following detailed description of the present invention, taken in conjunction with the accompanying drawings of which.

DETAILED DESCRIPTION OF THE PREFERRED EMBODIMENT

Figure 1:
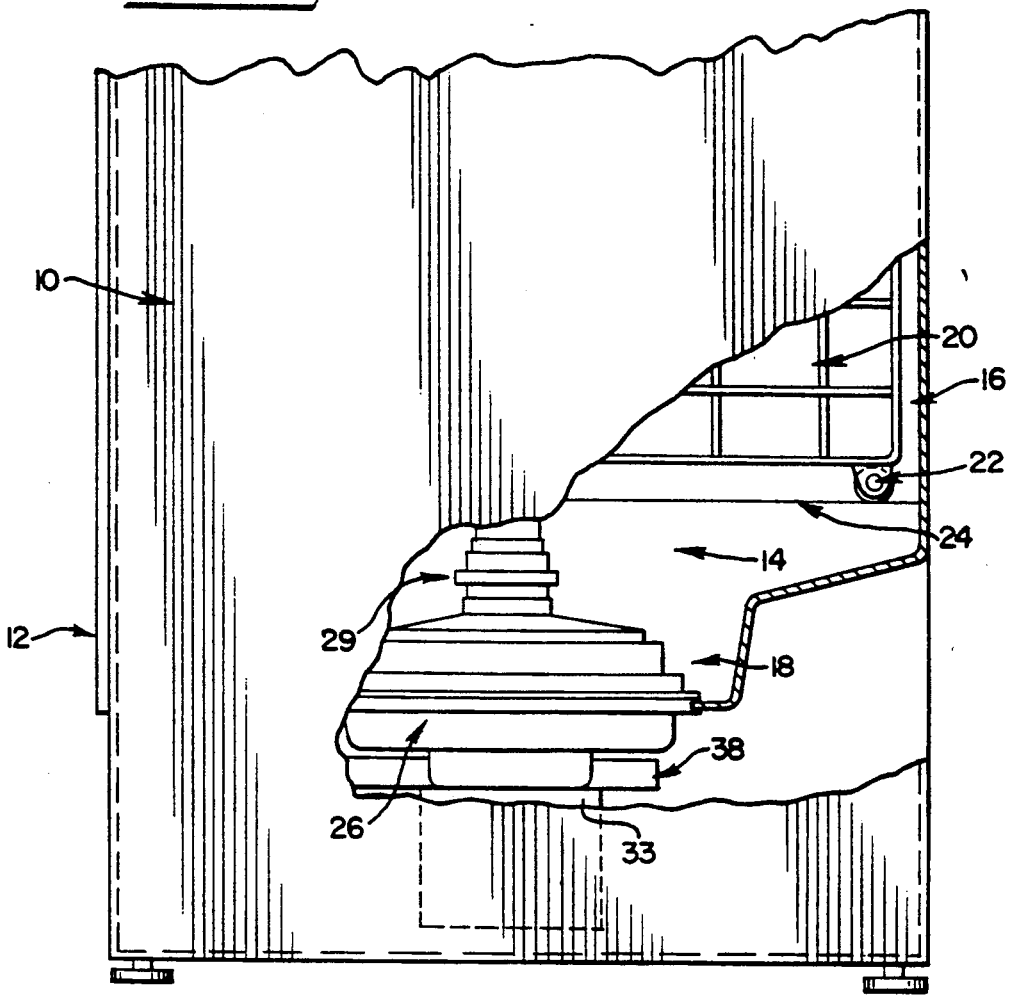
FIG. 1 is a side view of a dishwasher with a portion cutaway to show the interior thereof.

FIG. 1 is a side view of a dishwasher with a portion cutaway to show the interior thereof. The dishwasher 10 can be installed under a countertop or it may be left free standing. The dishwasher 10 has a door 12 which allows a user to access the inside of the dishwasher 10. The inside of the dishwasher 10 comprises a washing chamber generally indicated at 14. The washing chamber 14 is defined by the walls of a tub 16. The tub 16 can be made of porcelain enameled steel, plastic or any other suitable material. The tub 16 can be supported by a base (not shown) or may be self supporting. The tub 16 has a central depression formed therein which defines a sump 18. In the washing chamber 14 there is at least one dishrack 20 which is designed to hold plates, glasses, cups and other eating utensils. Most dishwashers have two dishracks although only a lower dishrack is shown in FIG. 1. The dishrack 20 has wheels 22 that are guided along a track 24 so that the dishrack 20 can be pulled out of the washing chamber 14 when the door 12 is open.

A pump 26 is mounted in the dishwasher 10 through an opening (not shown) in the sump 18. The pump 26 can be fastened to the sump 18 by common fastening devices such as bolts, screws and clamps. The pump 26 is mounted in the dishwasher 10 such that the top portion extends into the sump 18 and the bottom half extends below the sump 18. Extending from the top portion of the pump 26 is a spray arm and nozzle assembly 29 shown in FIG. 2. Extending from the bottom portion of the pump 26 is a drain outlet 38 to which a drain line (not shown) can be attached. Underneath the pump 26 is a bidirectional motor 33, shown in FIG. 1, which drives the pump 26. A watertight seal 27 provided on the pump 26 prevents fluid from leaking from the pump 26 onto the motor 33.

Figure 2:
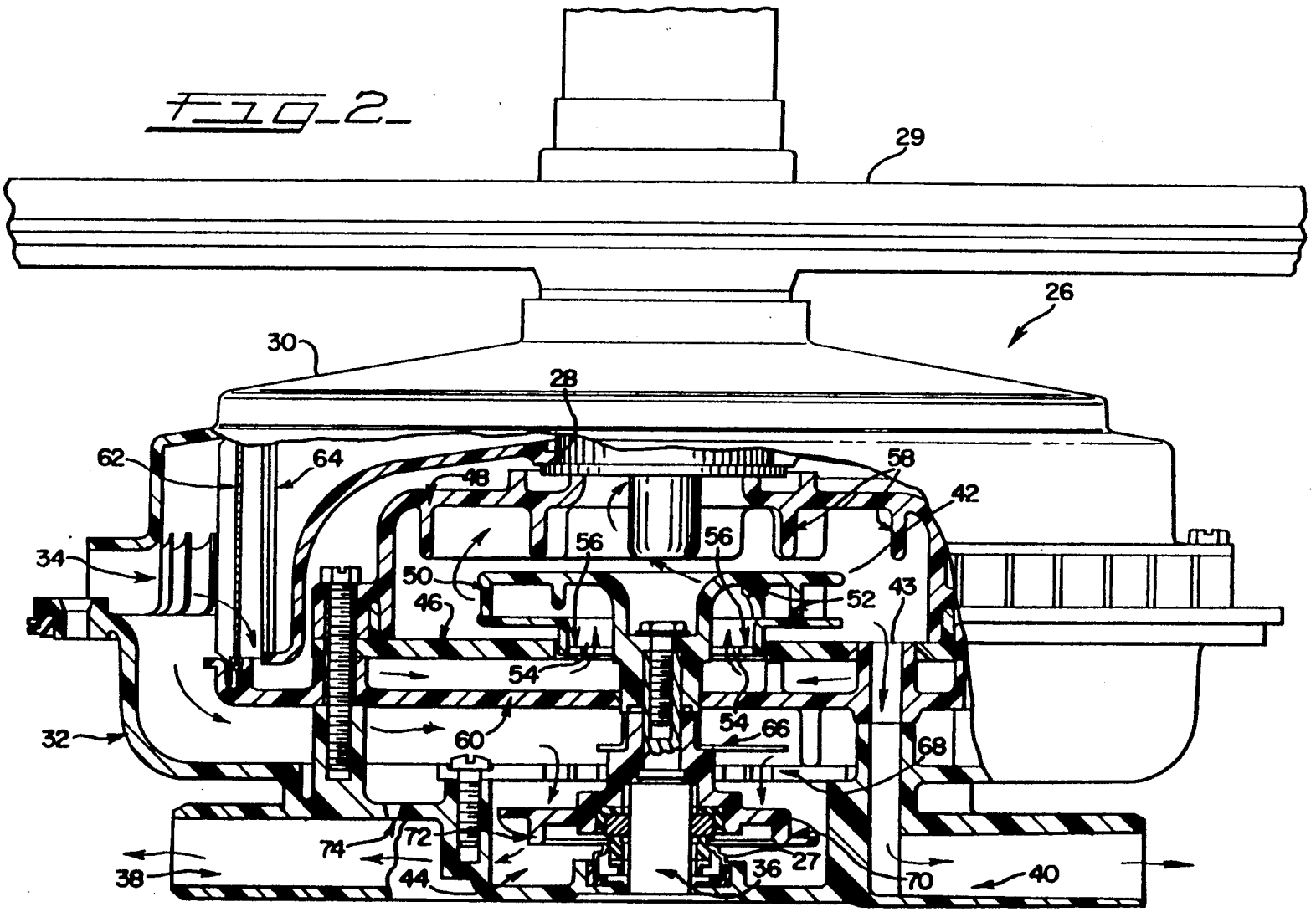
FIG. 2 is a cross-sectional view of a dishwasher pump in accordance with the present invention.

FIG. 2 is a cross-sectional view of the pump 26. The pump 26 has a top cover 30 and a base 32. The top cover 30 and the base 32 are shaped so that a gap 34 is left between the two when they are fastened together. Through the base 32 extends a shaft 36 associated with the motor 33. A drain outlet 38 is formed as an integral part of the base 32 and extends from the pump 26. A drain line (not shown) is connected to the drain outlet 38 to remove fluid from the dishwasher 10. A top shower conduit 40 is also formed in the base 32 to direct fluid from the pump 26 to a top shower arm (not shown).

The pump 26 has two main pump chambers, a recirculation pump chamber generally indicated at 42 and a drain pump chamber generally indicated at 44. The recirculation pump chamber 42 comprises a base plate 46 and a top plate 48 fastened together to form a chamber housing. In the housing formed between the base plate 46 and the top plate 48 is a recirculation impeller 50 which is connected to the motor shaft 36 through a shaft conduit 84 shown in FIG. 4 so that the impeller 50 rotates in either a clockwise or counterclockwise direction depending on which direction the motor 33 is operating.

Figure 3:
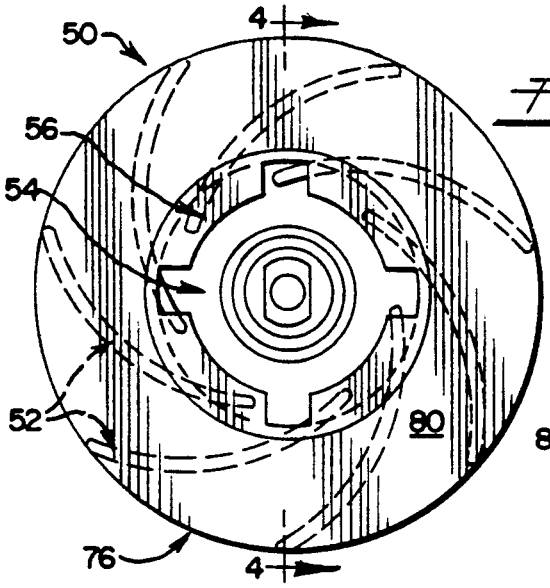
FIG. 3 is a plan view of a recirculation pump impeller in accordance with the present invention.
Figure 4:
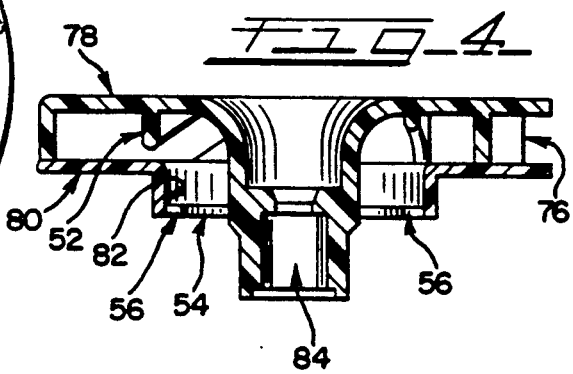
FIG. 4 is a cross-sectional view of the pump impeller of FIG. 3.

The recirculation impeller 50 is best shown in FIGS. 3 and 4. The impeller 50 is a disc-like object having a top cover 78 and a bottom cover 80. The generally disc-like top cover 78 has a shaft conduit 84 at the axis of rotation. In this embodiment, seven vanes 52 are equally spaced about the axis of rotation with each vane 52 extending along a substantially volute path to the outer periphery of the disc-like top cover 78. The seven vanes 52 descend axially from the top cover 78 and terminate at and are fixed to the bottom cover 80. Outlets 76 are formed between each vane 52. The bottom cover 80 has a central opening 82 defining a fluid inlet 54 to the impeller 50. The fluid inlet 54 is defined by a discontinuous annular flange 56. The discontinuous annular flange 56 has four equally spaced flanges extending transversely towards the axis of rotation. As can be appreciated, the discontinuous annular flange 56 reduces the inlet area 54 of the impeller 50. The present invention is not limited to having four equally spaced flanges, however. The inlet 54 of the impeller 50 is aligned with the space provided in the base plate 46 so that fluid will enter the wash impeller 50 through the inlet 54. When the fluid enters the impeller 50, it is confined between the top and bottom covers, 78 and 80. The vanes 52 direct the fluid from the center of the impeller 50 to the outlets 76. As the fluid exits the impeller 50 it strikes the sides of the top plate 48 of the recirculation pump 42. The vanes 58 in the top plate 48 direct the fluid in an upward manner out of the recirculation pump chamber 42 through the conduit 28 toward the spray arm/nozzle assembly 29. An entrance aperture 43 is formed in the screen filter holder 60 connecting the recirculation pump chamber 42 with the top shower conduit 40.

Returning to the pump 26 shown in FIG. 2, below the base plate 46 is a screen filter holder 60. The filter holder 60 is at a sufficient distance from the base plate 46 so that a channel is formed therebetween allowing fluid to flow from the sump 18 to the impeller 50 of the recirculation pump chamber 42. The filter holder 60 holds a circular screen filter 62 around the outside of the recirculation pump chamber 42. A rotatable backwash rinse arm 64 is supported by the conduit 28. Fluid enters the rinse arm 64 from the conduit 28. The rinse arm 64 cleans the screen filter 62 as will be described later.

The drain pump housing 44 is formed between a chopper plate 68 and the base 32. A drain impeller 70 is connected to the shaft 36 so that it can rotate in either a clockwise or counterclockwise direction inside the housing 44. A cutter disk 66 is connected to the shaft 36 and rotates about it in either a clockwise or counterclockwise direction above the chopper plate 68. An example of a cutter disk is disclosed in U.S. Pat. No. 4,795,102 to Jordan et al. Fluid flows from the sump 18 to the drain pump housing 44 through the channel formed between the screen filter holder 60 and the base 32. The fluid enters the drain pump housing 44 through holes formed in the chopper plate 68. The drain impeller 70 has vanes 72 which direct the fluid out of the drain pump housing 44. The outlet of the drain pump 44 comprises a drain outlet 38. An aperture 74 is located in the base 32 connecting the drain outlet 38 with the channel formed between the filter holder 60 and the base 32 above the drain impeller 70.

The dishwasher 10 operates in the following manner. The sump 18 is filled with fluid such as water from a tap (not shown). The bidirectional motor 33 of the pump 26 rotates the recirculation impeller 50 and the drain impeller 70 in a clockwise direction. The fluid is drawn from the sump 18 into the pump 26 through the gap 34 formed between the top cover 30 and the base 32. Specifically, during recirculation when both impellers 50 and 70 are rotating clockwise, the fluid is drawn through the gap 34 and through the screen filter 62 into the channel formed between the screen filter holder 60 and the base plate 46 of the recirculation pump chamber 42. The screen filter 62 keeps larger food and other particles out of the recirculation pump chamber 42. The fluid travels through this channel and enters the recirculation pump chamber 42 through the discontinuous annular flange 56 of the inlet 54 in the recirculation impeller 50. The fluid is then directed by the rotating recirculation impeller 50 and the flanges 52 therein out of the recirculation impeller 50 through the impeller outlets 76 bringing the fluid in contact with the side walls of the top plate 48. The vanes 58 in the top plate 48 direct the fluid out of the recirculation pump chamber 42 through the conduit 28. The fluid traveling out the conduit 28 is delivered to the rinse arm 64 and the spray arm/nozzle assembly 29.

The rinse arm 64 rotates with the conduit 28. Fluid sprays out of the rinse arm 64 through the screen filter 62 in a direction opposite to that which the fluid enters the screen filter 62 and thereby helps keep the screen filter 62 clean and unclogged. This spray of fluid helps dislodge food and dirt particles that may clog the screen filter 62.

The spray arm/nozzle assembly 29 rotates on the conduit 28 in the dishwashing chamber 14. The design of the spray arm/nozzle assembly 29 directs the fluid against the articles to be cleaned in the dishracks 20.

In addition to the rinse arm 64 and the spray arm-/nozzle assembly 29, fluid is also directed from the recirculation pump chamber 42 to a top shower (not shown) via a top shower conduit 40. An entrance aperture 43 to the conduit 40 is formed in the base plate 46 of the recirculation pump chamber 42. As the fluid is thrown out of the impeller 50, some of the fluid enters the conduit 40 through this entrance aperture 43. The top shower is located on the ceiling of the washing chamber 14 so that it can spray fluid on top of the articles in the dishracks 20.

A noise is often associated with the pump 26 during recirculation. In the dishwasher 10, a certain amount of air is trapped under the dome of the top cover 30 and small amounts of air continually enter this area during recirculation. When the fluid enters the recirculation pump impeller 50, it is believed that air bubbles or pockets are formed from the trapped air combining with the recirculating fluid to create the noise. The discontinuous annular flange 56 reducing the inlet area of the wash impeller 50 has been found to reduce the noise emission from the pump 26. It is believed that by reducing the inlet 54 with the discontinuous annular flange 56, the air bubbles or pockets are caused to break down thus reducing the size and quantity of air bubbles in the fluid and the noise created by those bubbles.

During recirculation the drain pump impeller 70 is also attempting to pump fluid toward the drain outlet 38. The drain pump impeller 70 is, however, inefficient when rotating in a clockwise or reverse manner. The drain outlet 38 from the drain pump chamber 44 is connected to a drain line (not shown). The drain line is brought outside of the washing chamber 14 and is led from the bottom of the dishwasher 10 to a point at or near the top of the dishwasher 10 and then looped back down towards the bottom and subsequently to a drain. A dishwasher may have, for example, a 32" (inch) loop which means that there is 32 inches of drain line between the bottom of the dishwasher 10 and the uppermost loop point. Most of the time the fluid that is pressurized in and pumped out of the drain pump chamber 44 during recirculation will not pass the uppermost loop point. Under certain operating conditions, however, the fluid pumped into the drain line will pass the uppermost loop point resulting in the possibility of fluid being siphoned from the sump 18. In order to reduce the possibility of having fluid siphoned from the sump 18, an aperture 74 is created between the drain outlet 38 and the channel formed between the screen filter holder 60 and the base 32 of the pump 26. The aperture 74 creates a flow path between the fluid that enters the drain pump chamber 44 through the channel and the fluid leaving the pump 26 through the drain outlet 38. Before the pressure in the drain line increases enough to cause fluid flow past the uppermost loop point, the aperture 74 at least partially relieves the pressure by allowing some fluid to flow from the drain outlet 38 to the channel above the drain impeller 70. In essence, the aperture 74 acts as a bleed-off valve for high pressure conditions. A loop is thus created between the drain outlet 38 and the inlet to the drain pump chamber 44 which prevents fluid from rising past the uppermost loop point and being siphoned out the sump 18.

When the dishwasher 10 has completed a recirculation cycle, the sump 18 is filled with used fluid that needs to be drained from the dishwasher 10. The bidirectional motor 33 now operates to rotate the recirculation impeller 50 and the drain impeller 70 in a counterclockwise direction. Because of the forces exerted by the impellers 50 and 70 rotating in a counterclockwise direction, the fluid from the sump 18 enters the channel formed between the filter holder 60 and the base 32 through the gap 34 created by the top cover 30 and the base 32. The fluid traveling through this channel does not pass through the screen filter 62. Instead, the fluid comes in contact with the cutter disk 66. The cutter disk 66 rotates with shaft 36 and slices large food and other particles that have found their way into the pump 26. The fluid and cut up particles then pass into the drain pump chamber 44 through the holes in the chopper plate 68. The rotating impeller 70 with vanes 72 formed thereon directs the fluid out of the drain pump chamber 44 and into the drain outlet 38 which is connected to a drain line formed in a drain loop as previously described and leading to a disposal system such as a sewer. In this direction of rotation, the fluid exiting through the drain outlet 38 and drain line has enough pressure to pass over the loop point in the drain line. The fluid in the sump 18 is thus quickly drained.

There are two problems that are associated with a drain pump during the drain cycle. First, the pressure of the fluid being pumped out may be great enough to cause splash at the end of the drain line. The second problem is the noise associated with the drain pump chamber 44 and impeller 70 when near the end of the drain cycle. At the end of the drain cycle, there is usually only a little fluid, known as a slug, left to be pumped out. The slug will be pumped out of the drain outlet 38 followed by a pocket of air. The slug travels up the drain line but it cannot make it past the uppermost loop point in the drain line and thus gravity pulls the slug back toward the drain pump chamber 44. The descending slug strikes the drain impeller 70 thereby creating a slurping noise. The slug is pumped out again followed by a pocket of air and again it finds its way back to the impeller 70. The slurping noise is created each time the slug strikes the impeller 70.

In order to eliminate the noise associated with the rhythmic motion of the slug, aperture 74 creates a passageway between the drain outlet 38 and the channel above the drain impeller 70. When the slug is pumped out the drain outlet 38 followed by a pocket of air, some of the fluid retained in the channel above the aperture 74 flows into the air pocket behind the slug. Thus when the slug slides back down the drain line towards the drain impeller 70, it strikes the fluid that has filled the air pocket. This breaks the rhythmic pattern of the slug flow.

In addition, if the fluid is flowing out of the drain pump 44 under great pressure thereby creating splash at the end of the drain line, the aperture 74 allows some of that fluid to flow or bleed off into the chamber above the drain impeller 70 thus reducing the pressure in the drain line and slowing the pump out rate to reduce splashing.

While this invention has been shown and described in connection with a preferred embodiment, it is apparent that certain changes and modifications, in addition to those mentioned above, may be made form the basic features of the present invention. Accordingly, it is intended that the scope of the invention be defined by the following claims, including all equivalents.

We claim:

1. A dishwasher pump comprising:

a drive motor;

a pump housing;

a first pumping chamber located within said housing having fluid ingress and egress openings;

a second pumping chamber located within said housing having fluid ingress and egress openings, said second chamber axially spaced from said first pumping chamber;

a first impeller rotated by said motor for moving fluid between said first pumping chamber's ingress and egress openings, said first impeller including a cover having an opening defining a fluid inlet portion;

a second impeller rotated by said motor for moving fluid between said second pumping chamber's ingress and egress openings; and throttling means fixed to said cover adjacent said fluid inlet portion of said first impeller and rotatable therewith, said throttling means including flange means extending transversely relative to the axis of rotation for reducing the impeller fluid inlet area to lower pump noise by interrupting air pockets entrained in fluid entering the fluid inlet portion of said first impeller.

2. A dishwasher pump according to claim 1 wherein said throttling means comprises a discontinuous annular flange.

3. A dishwasher pump according to claim 2 wherein said discontinuous annular flange has four equally spaced flange segments.

* * * * *

UNITED STATES PATENT AND TRADEMARK OFFICE

CERTIFICATE OF CORRECTION

PATENT NO. : 5,143,513

DATED : September 1, 1992

INVENTOR(S) : Herbert E. Scott, et al

It is certified that error appears in the above-indentified patent and that said Letters Patent is hereby corrected as shown below:

| | |
|---|---|
| Cover page, Item [75]: Inventors | "David I. Ellingson, Newton;" should be deleted. |
| Col. 4, line 22 | after "pump" insert -- chamber -- |

Signed and Sealed this

First Day of March, 1994

Bruce Lehman

*Attest:*

BRUCE LEHMAN

*Attesting Officer*

*Commissioner of Patents and Trademarks*